US006789554B2

(12) United States Patent
Koizumi

(10) Patent No.: US 6,789,554 B2
(45) Date of Patent: Sep. 14, 2004

(54) REMOVING TONER FROM PRINTED MATERIAL

(75) Inventor: David H. Koizumi, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 10/406,414

(22) Filed: Apr. 3, 2003

(65) Prior Publication Data

US 2003/0205245 A1 Nov. 6, 2003

Related U.S. Application Data

(62) Division of application No. 09/666,217, filed on Sep. 21, 2000, now Pat. No. 6,569,256.

(51) Int. Cl.[7] ..... B08B 3/00

(52) U.S. Cl. ..... 134/184; 134/1; 134/2; 134/10; 134/58 R; 134/64 R; 134/113; 134/149; 15/3.51; 15/93.1; 15/404; 219/121.67; 399/23; 399/34; 399/343; 427/466

(58) Field of Search ..... 134/184, 1, 2, 134/10, 58 R, 64 R, 113, 149; 219/121.67; 399/23, 34, 343; 427/466; 15/3.51, 404, 93.1; 366/120; 430/117; 451/41; 433/119

(56) References Cited

U.S. PATENT DOCUMENTS 4,064,885 A * 12/1977 Dussault et al. ..... 134/58 R
4,364,147 A * 12/1982 Biedermann et al. ..... 15/404
5,710,966 A * 1/1998 Otsuka et al. ..... 399/343
5,865,901 A * 2/1999 Yin et al. ..... 134/2

* cited by examiner

*Primary Examiner*—Randy Gulakowski
*Assistant Examiner*—Gentle E. Winter
(74) *Attorney, Agent, or Firm*—Trop, Pruner & Hu, P.C.

(57) ABSTRACT

Toner xerographically adhered to a material, such as a sheet of paper, may be removed using a solvent-based or solvent-less approach. The application of ultrasonic tamping, scraping and brushing may aid in removing toner particles. In a solvent-based approach, a solvent may be applied generally or the solvent may be targeted specifically to the toner covered portions of the material to loosen the adhesive securement of the toner to the material. Thereafter, the toner is subjected to a mechanical abrasion using ultrasonic and physical agitation to cause flaking of the toner.

4 Claims, 4 Drawing Sheets

REMOVING TONER FROM PRINTED MATERIAL

This is a divisional of prior application Ser. No. 09/666,217, filed Sep. 21, 2000, now U.S. Pat. No. 6,569,256.

BACKGROUND

This invention relates generally to removing toner from xerographically printed material.

In conventional xerographic printing or copying processes, a light image of an original to be copied is recorded in the form of an electrostatic latent image. The electrostatic latent image is formed on a photosensitive member and the latent image is subsequently rendered visible by the application of electroscopic thermoplastic resin particles commonly called toner.

The photosensitive member is charged and then exposed to light from a laser or light emitting diode to form the electrostatic latent image. The electrostatic latent image is developed by bringing a developer mixture into contact therewith. A dry or wet development procedure may be utilized. A dry developer mixture usually provides carrier granules having toner particles adhering triboelectrically thereto. Toner particles are attracted from the carrier granules to the latent image forming a toner powder image thereon.

After the toner particles have been deposited on the photosensitive member, in the configuration of the image, the toner particles are transferred to a copy sheet by the application of pressure or an electrostatic force. In some cases, the developed image may be transferred to an intermediate transfer member and thereafter transferred to the copy sheet.

After the transfer of the developed image is completed, the copy sheet advances to a fusing station that may include a fuser roll and a pressure roll. The developed image is then fused to the copy sheet by pressing the copy sheet between fusing and pressure rolls, thereby forming a permanent image. The attachment of the toner to the paper is primarily due to an adhesive, included in the toner, that adhesively secures the toner to the paper upon the application of pressure and/or heat.

A very large number of sheets of paper are run through printers. Many of these printed pages are never used and the paper is simply either discarded or sent for recycling. In many businesses, the amount of paper that is wasted in this way, never to be used, is staggering. It is estimated that about twenty percent of the documents that are printed are immediately thrown away. A large percentage of the remaining paper is also eventually thrown away without being substantially wrinkled, written on or otherwise disrupted.

Thus, there is a need for a better way to reuse printed material.

DETAILED DESCRIPTION

Figure 1:
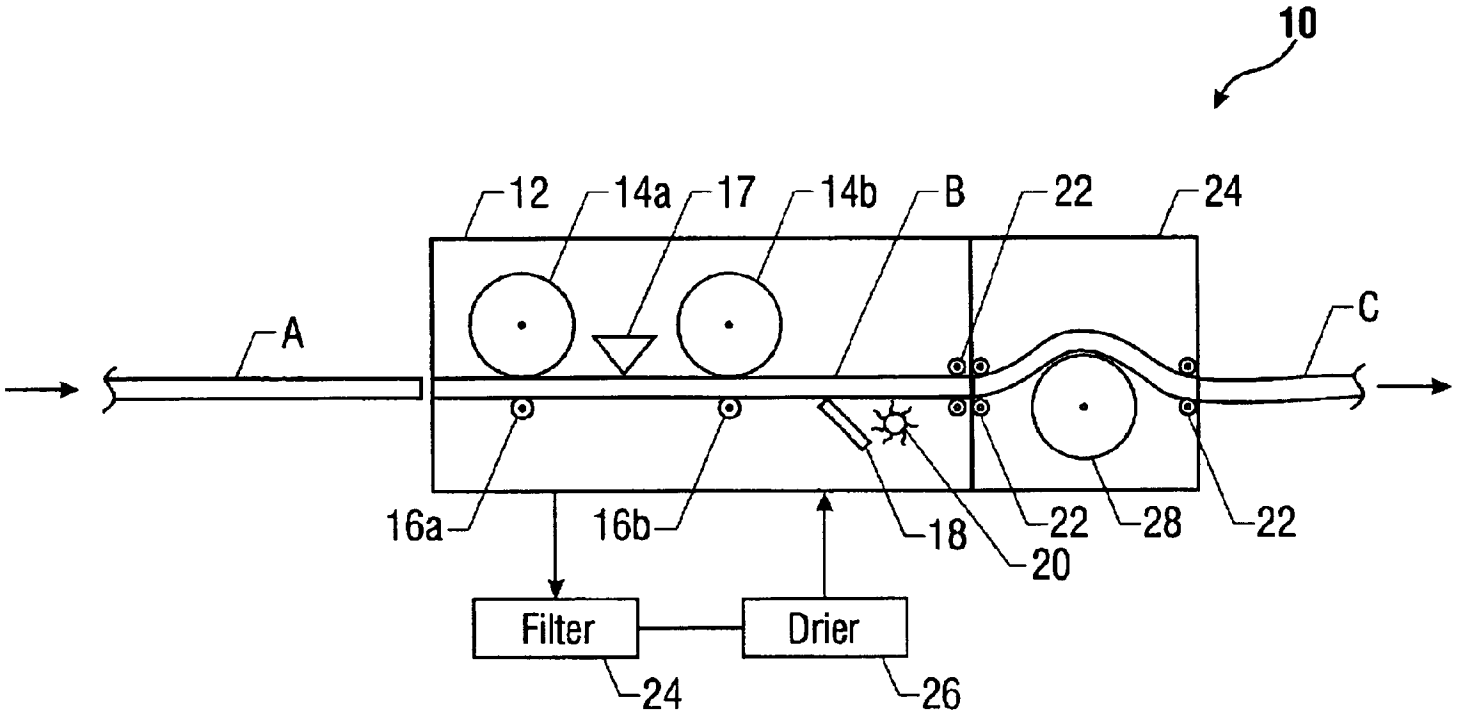
FIG. 1 is a schematic depiction of one embodiment of the present invention.

Referring to FIG. 1, a deprinter 10 may receive a sheet of paper indicated as A. The sheet A has xerographic printing on its lower side. While a sheet of paper A is illustrated, any xerographically printed material may be processed including paper rolls and plastic film materials. The sheet A enters a tank 12 filled with a suitable solvent pursuant to a wet process embodiment. A suitable solvent may be one which preferentially attacks the adhesive securing the printing toner to the paper rather than dissolving the toner itself. Examples of suitable solvents include members of the organic sulfone or sulfoxide families including dimethyl sulfoxide ($(CH_3)_2SO$).

The sheet A may be advanced to the position indicated at B wherein it is immersed in the bath of a suitable solvent. The adhesion of the toner to the paper is interrupted by the solvent without adversely affecting the paper or the used toner.

An ultrasonic tamper 17 may be utilized to loosen the toner from the paper. The tamper 17 may include a V-shaped head that is ultrasonically reciprocated towards and away from the paper to hit or tamp the paper to loosen the toner. The tamper 17 micro bends the paper. Since the toner is more brittle than the paper, the toner starts to flake off of the paper. Sets of rollers 14*a* and 14*b* may tension the paper and further cause the toner to be broken into flakes.

In addition, an ultrasonic scraper 18 may be utilized to remove any flakes of toner particles. The scraper 18 may include a sharp edged, obliquely aligned, rigid member that is ultrasonically agitated to scrape the toner from the paper. The member may be made of metal or damped resonant material such as sapphire, as two examples.

Similarly, a stiff rotary brush 20 may be rotated against the printed surface of the sheet B to remove any remaining toner flakes.

The solvent in the tank 12 may be subjected to continuous filtering in a filter 24 and drying in a dryer 26 to remove water that may be absorbed by the solvent. A pair of squeeze rolls 22 may be utilized to remove any remaining solvent.

Thereafter, the sheet, indicated at C, may be subjected to solvent recovery by causing the sheet to ride over a rotating vacuum drum 28 in a solvent recovery stage 24. The sheet C may be pressed against the vacuum drum 28 through the operation and positioning of the squeeze rolls 22.

Figure 2:
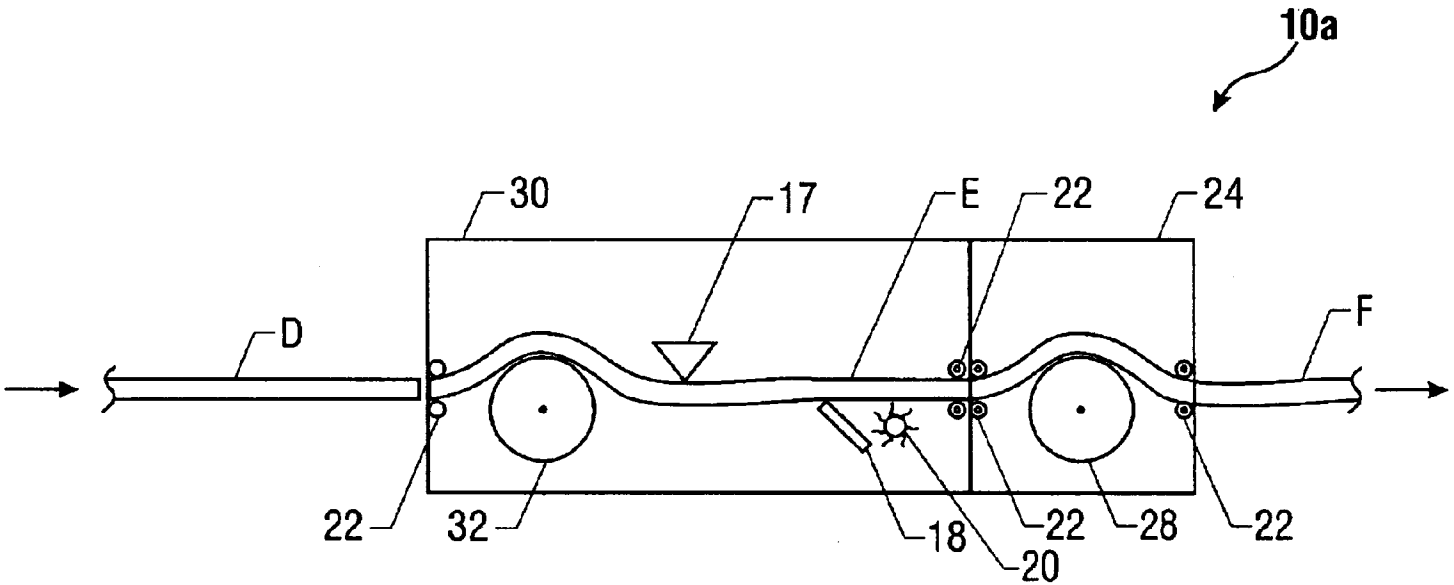
FIG. 2 is a schematic depiction of another embodiment of the present invention.

Referring next to FIG. 2, a deprinter 10*a* pursuant to semi-wet process may involve the use of a solvent vapor, such as dimethyl sulfoxide vapor, to facilitate the removal of the fused toner. Solvent filtering and recovery may be unnecessary.

In this embodiment, a vapor drum 32 is provided within a housing 30. A paper sheet indicated as D, may be advanced into the housing 30 where it assumes the position indicated at E. The vapor drum 32 creates a fog, mist or airborne suspension of solvent, using ultrasonic techniques for example. The fog or mist may also be formed by heating, nebulizing, spraying or other techniques.

The sheet E then may be subjected to ultrasonic tamping by the tamper 17 and ultrasonic scraping by the scraper 18. Finally, the sheet E may be subjected to brushing using the rotary brush 20.

The sheet E then may be passed through rollers 22 into a solvent purge housing 24. The solvent purge housing 24 may include a rotating vacuum drum 28, situated between a pair of rollers 22, to remove as much of the solvent as possible from the sheet, indicated now at F.

Figure 3:
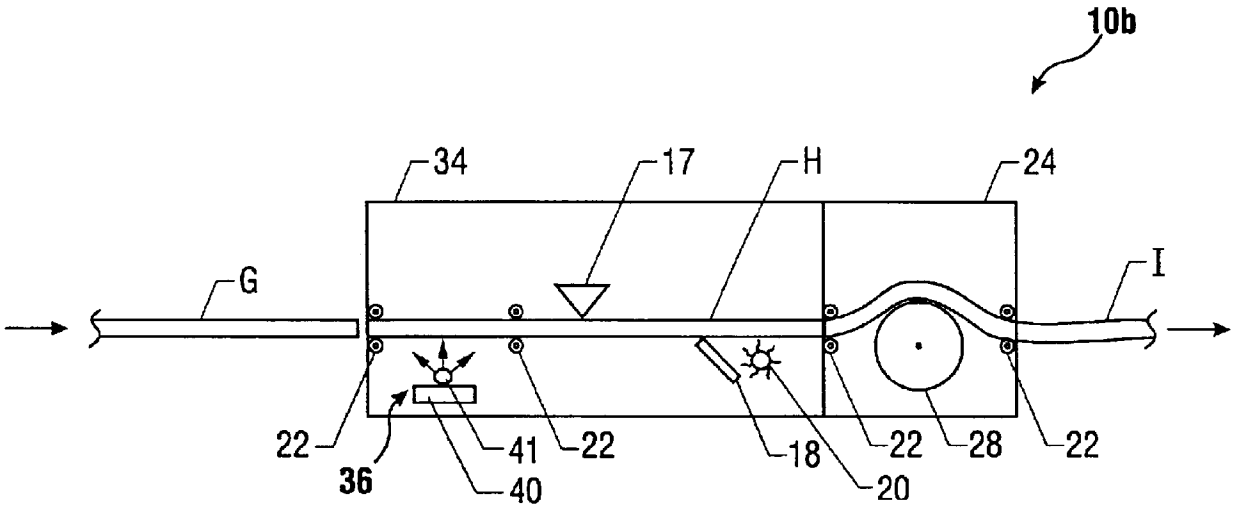
FIG. 3 is a schematic depiction of still another embodiment of the present invention.

Turning next to FIG. 3, a dry process may use a pair of stages 34 and 24. A sheet G is enters the stage 34. The sheet, in the position H, is subjected to a spray of a suitable solvent from the sprayer 36. The solvent may be sprayed onto the paper to remove the fused toner. The solvent may attack the adhesive that secures the toner to the paper and may be the same type of solvent described previously.

The solvent may be sprayed in very small micro quantities using a thermal spray head 41 for example of the type used in ink jet printers. To reduce the use of solvent, optical cameras or sensors 37 may be placed on the spray head. The sensors 30 develop signals so that the solvent is only sprayed where the toner is detected. The spray head 41 may be mounted on a support 40 for sliding movement along the width of the sheet H so that a sensor 37 senses the nature of the printing on the sheet 14 before the spray head 41 arrives at the sensed location.

Thereafter, the same tamping, scraping and brushing processes may be undertaken using the ultrasonic tamper 17, ultrasonic scraper 18 and rotary brush 20 in one embodiment. In a final stage 24, the solvent is purged, for example, using the techniques described previously or the solvent is otherwise chemically neutralized.

Figure 4:
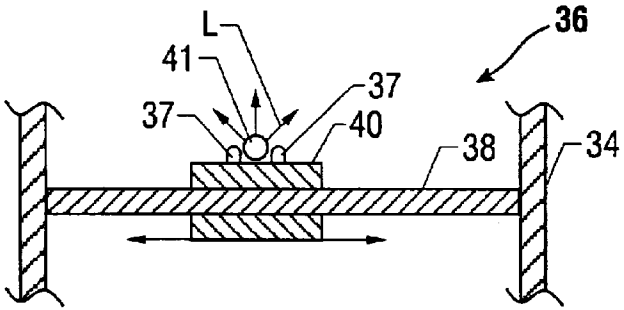
FIG. 4 is an enlarged, vertical cross-sectional view of the embodiment shown in FIG. 3.

Referring to FIG. 4, the spray nozzle 41 may ride on a tubular support 40 along a bar 38 to enable it to reciprocate along the width of the sheet of paper indicated as H in FIG. 3 in the direction of the arrows in FIG. 4. The spray solvent indicated as L may be directed precisely at the toner so that solvent is not wasted by spraying it over the entire sheet.

Figure 5:
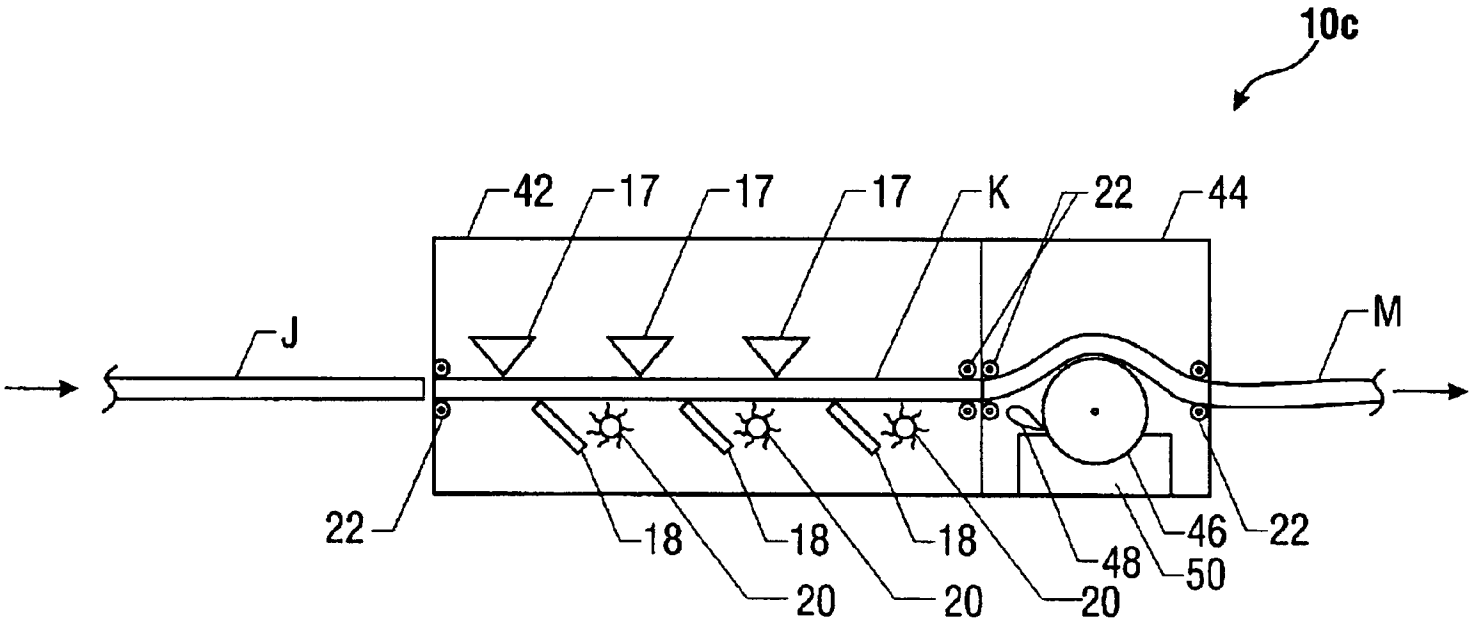
FIG. 5 is a schematic depiction of still another embodiment of the present invention.

Referring finally to FIG. 5, in accordance with still another embodiment, a solventless process may be utilized that relies on ultrasonic tampers 17 and scrapers 18 along with a sticky silicone or rubber drum 46. The paper J is caused to enter the housing 42. The paper, in the position indicated at K, is subjected to a series of tamping, scraping and brushing stages in suitable repetition to break up the toner into flakes and to loosen or remove those flakes. In this case, a series of tamping stages may use a tamper 17 followed by a scraper 18 and a rotary brush 20.

A sticky surfaced rotating drum 46 in a stage 44 removes the loosened toner. The drum 46 is continuously cleaned and dressed with new adhesive, using a scraper/applicator 48 to maintain a sticky adhesive surface that removes the loosened toner from the paper.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A device comprising:

a solvent applicator to apply solvent to paper;

a device coupled to said applicator to detect the location of toner on said paper; and an ultrasonic tamper to ultrasonically impact the surface of said paper, said tamper including a head to reciprocate towards and away from and to physically contact said paper.

2. The device of claim 1 wherein said solvent applicator includes a solvent bath.

3. The device of claim 1 wherein said applicator to apply a solvent vapor to said toner.

4. The device of claim 1 wherein said solvent applicator to apply a solvent to toner to weaken the adhesive attachment of the toner to the paper.

* * * * *